US010601126B2

(12) United States Patent
Yang

(10) Patent No.: US 10,601,126 B2
(45) Date of Patent: Mar. 24, 2020

(54) WATERPROOF CHIP ANTENNA

(71) Applicants: Ruidian Yang, Shenzhen (CN); SHENZHEN ANTOP TECHNOLOGY LIMITED, Shenzhen (CN)

(72) Inventor: Ruidian Yang, Shenzhen (CN)

(73) Assignees: SHENZHEN ANTOP TECHNOLOGY LIMITED, Shenzhen (CN); Ruidian Yang, Shenzhen (CN)

( * ) Notice: Subject to any disclaimer, the term of this patent is extended or adjusted under 35 U.S.C. 154(b) by 89 days.

(21) Appl. No.: 16/014,247

(22) Filed: Jun. 21, 2018

(65) Prior Publication Data

US 2019/0245266 A1 Aug. 8, 2019

(30) Foreign Application Priority Data

Feb. 5, 2018 (CN) ..... 2018 2 0194492 U
Feb. 5, 2018 (CN) ..... 2018 2 0197329 U
Feb. 5, 2018 (CN) ..... 2018 2 0197330 U

(51) Int. Cl.
*H01Q 1/42* (2006.01)
*H01Q 1/12* (2006.01)
*H01Q 23/00* (2006.01)
*H01Q 1/38* (2006.01)

(52) U.S. Cl.
CPC ..... *H01Q 1/42* (2013.01); *H01Q 1/12* (2013.01); *H01Q 1/38* (2013.01); *H01Q 23/00* (2013.01)

(58) Field of Classification Search
CPC .. H01Q 1/42; H01Q 1/12; H01Q 1/38; H01Q 21/00
USPC ..... 343/872
See application file for complete search history.

(56) References Cited

U.S. PATENT DOCUMENTS

2010/0245188 A1* 9/2010 Suzuki ..... H01Q 1/3266 343/713
2010/0309089 A1* 12/2010 Collinson ..... H01Q 1/42 343/872

* cited by examiner

*Primary Examiner* — Andrea Lindgren Baltzell
(74) *Attorney, Agent, or Firm* — Muncy, Geissler, Olds & Lowe, P.C.

(57) ABSTRACT

The invention specifically relates to a waterproof chip antenna comprising a chip body including hanging holes, gaskets embedded on the peripheries of the hanging holes, and an oscillator piece arranged in the chip body. The chip body is generally hung with hard objects, such screws and hard rods. Compared with the prior art, the waterproof chip antenna has the advantage that the hanging holes are stressed uniformly through the gasket embedded on the peripheries of the hanging holes to prevent the hanging holes from wear and tear caused by local stress from the hard objects, avoiding that the chip body is wear through by the hard objects to make water entry into and thus affecting the signal reception of the antenna. In addition, the chip setting mode facilitates arrangement of the antenna at different places to receive signals better, and the hanging holes also facilitate outdoor hanging with high flexibility. In conclusion, the waterproof chip antenna according to the present invention has good waterproofness and is suitable for outdoor use.

20 Claims, 4 Drawing Sheets

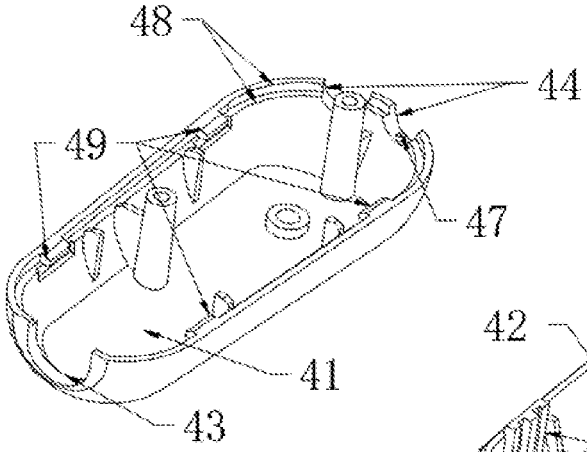
FIG. 5c
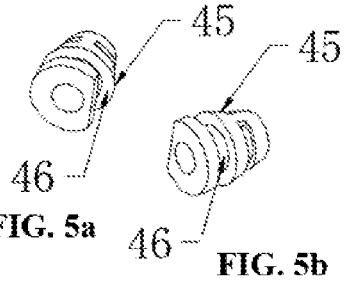
FIG. 5a
FIG. 5b
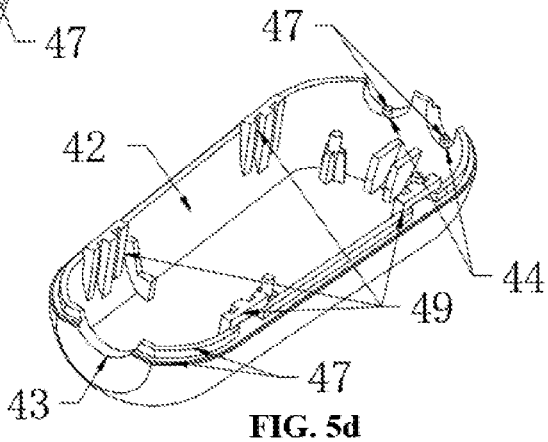
FIG. 5d
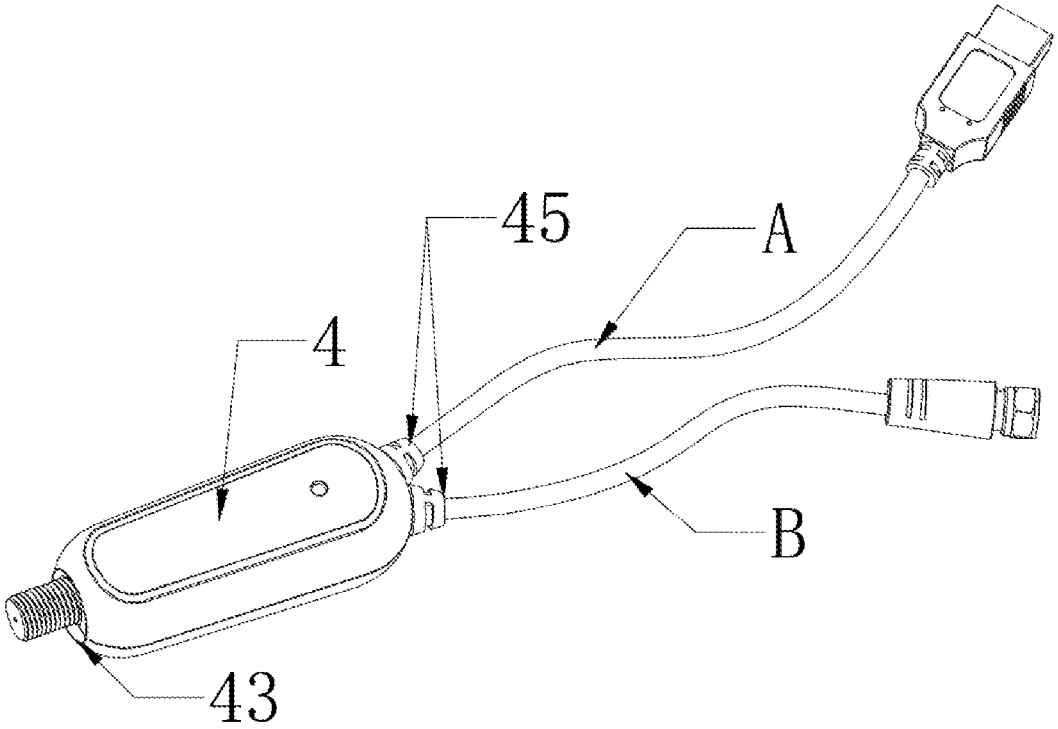
FIG.6

WATERPROOF CHIP ANTENNA

TECHNICAL FIELD

The invention relates to the field of waterproof antennas, in particular to a waterproof chip antenna.

BACKGROUND

Communication media in people's lives are increasing with economic development, while television is an indispensable information medium in the family all the time. With the improvement of living standard, people's requirements for television channels become increasingly higher so that an antenna plays its important role. An ordinary outdoor antenna is large in size and has a relatively complex overall structure, so that it is different to be maintained due to damage as the antenna is exposed to wind, sun and rain every day, thus resulting high cost and short service life. In addition, the outdoor antenna can be only rotated within a small range due to fixed installation while the received signal is weak, and the antenna is inconvenient to move, and uneasy to place. At present, planar antennas on market hold plastic shell generally with thick structure. Some planar antennas are in chip structure, however, most of them are indoor antennas with poor waterproofness and low practicability and not suitable for outdoor use because of lack of fully considering all kinds of factors.

SUMMARY OF THE INVENTION

In order to overcome the above-mentioned shortcomings of the prior art, the invention provides a waterproof chip antenna suitable for outdoor use.

According to the present invention, a waterproof chip antenna comprises a chip body comprising a hanging hole, a gasket embedded on the peripheries of the hanging hole and an oscillator piece arranged in the chip body.

The chip body is generally hung with hard objects penetrating the hanging hole in prior art, such screws and hard rods. According to the present invention, the waterproof chip antenna has a desire advantage that the hanging hole are stressed uniformly through the gasket embedded on the peripheries of the hanging hole so that the hanging hole may avoid wear and tear caused by local stress from the hard objects, which can avoid that the chip body is wear through by the hard objects to make water entry into and thus affecting the signal reception of the antenna. The chip setting mode also facilitates arrangement of the antenna at different places to receive signals better, and the hanging hole facilitate outdoor hanging, making the antenna with high flexibility. In conclusion, the waterproof chip antenna according to the present invention has good waterproofness and is suitable for outdoor use.

Preferably, the gasket comprises a filling part embedded on the periphery of each hanging hole and a hole part penetrating the filling part.

When the antenna is hung up through the hole part, the hole part is locally stressed, while the filling parts makes the hanging hole stressed uniformly so that the hanging hole may avoid wear and tear caused by local stress from the hard objects, which can avoid that the chip body is wear through by the hard objects to make water entry into and thus affecting the signal reception of the antenna.

Preferably, the filling part is embedded around the hanging hole by interference fit with the handing hole.

Preferably, the gasket further comprises a gasket face arranged on one side of the filling part, and the hole part penetrates the gasket face and the filling part.

When arranged outdoors, the antenna position is easy to change due to strong wind, rainfall or other factors, causing that the antenna may be moved to the position with weak signal, affecting signal reception. The antenna is also easy to be damaged in movement process, so the antenna shall be fixed with screws or other fasteners at the position with good signal reception effect. The gasket face is arranged so that the screws or other fasteners may not directly contact with the chip body, but the antenna is fixed indirectly by pressing the gasket face, so that the chip body is free from wear, reducing the possibility of wear through of the chip body. Thus, the chip body remains beautiful with wear resistance and waterproofness improved.

Preferably, the gasket face comprises a pressure groove arranged on the periphery of the hole part.

The pressure groove is arranged so that no indentation affecting beauty is formed on the surface when the gasket face is pressed by the screws or other fasteners, since the pressure groove is equivalent to the preset indentation. In addition, the design of the pressure groove is similar to a seam allowance, which improves the airtightness. Accordingly, the connection position between the fasteners and the gasket face, the hole part, and even the periphery of the fixed position of the fasteners are prevented from being contaminated by sundries, thus improving the whole stability.

Preferably, the chip body is further provided with a groove around the periphery of the hanging hole, and the gasket is provided with a pad fit to the groove. The design of the groove and the pad is similar to a seam allowance, which improves the airtightness, so that the connection position between the gasket and the hanging hole may be prevented from being contaminated, and the gasket may thus avoid being separated from the hanging hole easily. Therefore, the wear resistance and the waterproofness are improved.

Preferably, the hanging hole comprises a first pinhole and a second pinhole which are of different sizes and arranged in the chip body.

When the waterproof chip antenna according to the present invention is used with the gasket removed, the smaller pinhole facilitates the antenna to be hung up by a support part firmly, and the larger pinhole facilitates the antenna to be taken from the support part easily. Especially, the antenna is fixed in the smaller pinhole by the fastener with a large edge and a small head, such as screws, while the antenna can be easily taken out from the fastener through the larger pinhole.

Preferably, more than one hanging hole is provided. Different numbers of the hanging holes can be set according to application scenarios. If force balance is further considered, it's desirable to set more than two hanging holes.

Preferably, the waterproof chip antenna further comprises a signal processor installed on the chip body and connected to the oscillator piece, and the connection position between the signal processor and the chip body is provided with a sealing ring.

The sealing ring is arranged between the signal processor and the chip body, so that water is prevented from entering the signal processor to cause short circuit and affect signal reception.

Preferably, the chip processor comprises a shell installed on the chip body and a circuit unit arranged in the shell and connected to the oscillator piece; and the connection position between the shell and the chip body is provided with a sealing ring.

Preferably, the shell comprises a face shell and a bottom shell which are correspondingly installed on both sides of the chip body, and the connection positions between the chip body and the face and bottom shell are provided with a sealing ring, respectively; and the circuit unit is arranged between the bottom shell and the chip body. The face shell and the bottom shell are correspondingly installed on both sides of the chip body, rather than on one side of the chip body, so that the structural stability is improved. Thus, during installation, the face shell and the bottom shell are indirectly arranged on the chip body with the face shell and the bottom shell fixed, rather than directedly fixed on the chip body, so that the chip body is prevented from being worn out, and the wear resistance and waterproofness are improved.

Preferably, the face shell and the bottom shell are correspondingly installed through fasteners distributed uniformly. The fasteners distributed uniformly ensure uniform stress and high stability.

Preferably, the bottom shell is provided with a clip, and the chip body is provided with a clamping hole matched with the clip. Such arrangement facilitates improving the stability of the integral structure.

Preferably, the shell is provided with a circuit unit support on which the circuit unit is installed. The circuit unit is suspended overhead in the shell through the circuit unit support, so that the circuit unit is not liable to come into contact with water even water enters the shell, as a result, the waterproofness is further improved.

Preferably, the circuit unit is a filter amplifier circuit.

Preferably, the waterproof chip antenna according to the present application further comprises a deconcentrator to which the signal processor is connected through a circuitry, comprising a power supply line and a signal line which are connected to the circuitry separately.

The circuitry is divided into the power supply line and the signal line by the deconcentrator, as the form of the power supply line can be USB plug or common household AC power plug, and the signal line can be common signal line, such as coaxial line, it's convenient connection for users. While the existing power supply line and the signal line are combined together through special plugs which may not be matched with electric appliance, causing that it's inconvenient connection with the electric appliance for users.

Preferably, the deconcentrator comprises a shell in which the power supply line and the signal line are arranged, and one end of the shell is provided with a wiring part used for connecting the signal processor line; and the other end of the shell is provided with an outgoing line part used for leading out the power supply line and the signal line.

Preferably, the shell comprises an upper shell and a lower shell which are correspondingly installed, and the circuit unit is installed between the upper shell and the lower shell; the wiring part for connecting the signal processor line is formed by one end of the upper shell and the lower shell jointly, and the outgoing line part for leading out the power supply line and the signal line is formed by the other end of the upper shell and the lower shell jointly.

Preferably, the deconcentrator further comprises two movable clamp tails which are fit to the outgoing part, and the power supply line and the signal line are led out through the two movable clamp tails separately. The movable clamp tails are arranged so that the power supply line and the signal line can be sheathed into the two movable clamp tails separately, facilitating the line design and mass production, no matter how the lengths of the power supply line and the signal line are set.

Preferably, the movable clamp tails are provided with notches, the shell is provided with slots fit to the notches; and the movable clamp tails are clamped by the shell through the slots.

Preferably, the slots are provided with convex points used for fixing the movable clamp tails.

Preferably, the upper shell and the lower shell are correspondingly installed through a fixing structure. The design of the fixing structure can improve the airtightness of the upper shell and the lower shell, in favor of preventing water.

Preferably, the upper shell and the lower shell are in buckled installation through a buckling structure. Such arrangement can improve the overall stability of the deconcentrator.

Compared with the prior art, the waterproof chip antenna according to the present invention has beneficial effects. On one hand, the hanging holes are stressed uniformly through the gaskets embedded on the peripheries of the hanging holes, so that the hanging holes may avoid wear and tear caused by local stress from the hard objects, which can avoid that the chip body is wear through by the hard objects to make water entry into and thus affecting the signal reception of the antenna. On the other hand, the chip setting mode facilitates arrangement of the antenna at different places to receive signals better, and the hanging holes also facilitate outdoor hanging, making the antenna with high flexibility. In addition, the sealing ring is arranged between the signal processor and the chip body, so that water is prevented from entering the signal processor to cause short circuit and affect signal reception. The line is divided into the power supply line and the signal line by the deconcentrator, it's convenient connection for users, as the form of the power supply line can be USB plug or common household AC power plug, and the signal line can be common signal line, such as coaxial line. While the existing power supply line and the signal line are combined together through special plugs which may not be matched with electric appliance, so that it's inconvenient connection with the electric appliance for users. According to the present invention, the line is not divided at the signal processor, but divided through a deconcentrator. Such arrangement can prevent water from entering the signal processor and ensure the waterproofness.

BRIEF DESCRIPTION OF THE DRAWINGS

FIG. 5*a* is a schematic view of two movable clamp tails according to the present invention.

FIG. 5*b* is another schematic view of the two movable clamp tails according to the present invention.

FIG. 5*c* is a schematic view of the upper shell of a deconcentrator according to the present invention.

FIG. 5*d* is a schematic view of the lower shell of the deconcentrator according to the present invention.

FIG. 6 is an overall schematic view of the deconcentrator according to the present invention.

DETAILED DESCRIPTION

The invention will be explained in more detail below in combination with embodiments and attached figures.

Figure 1:
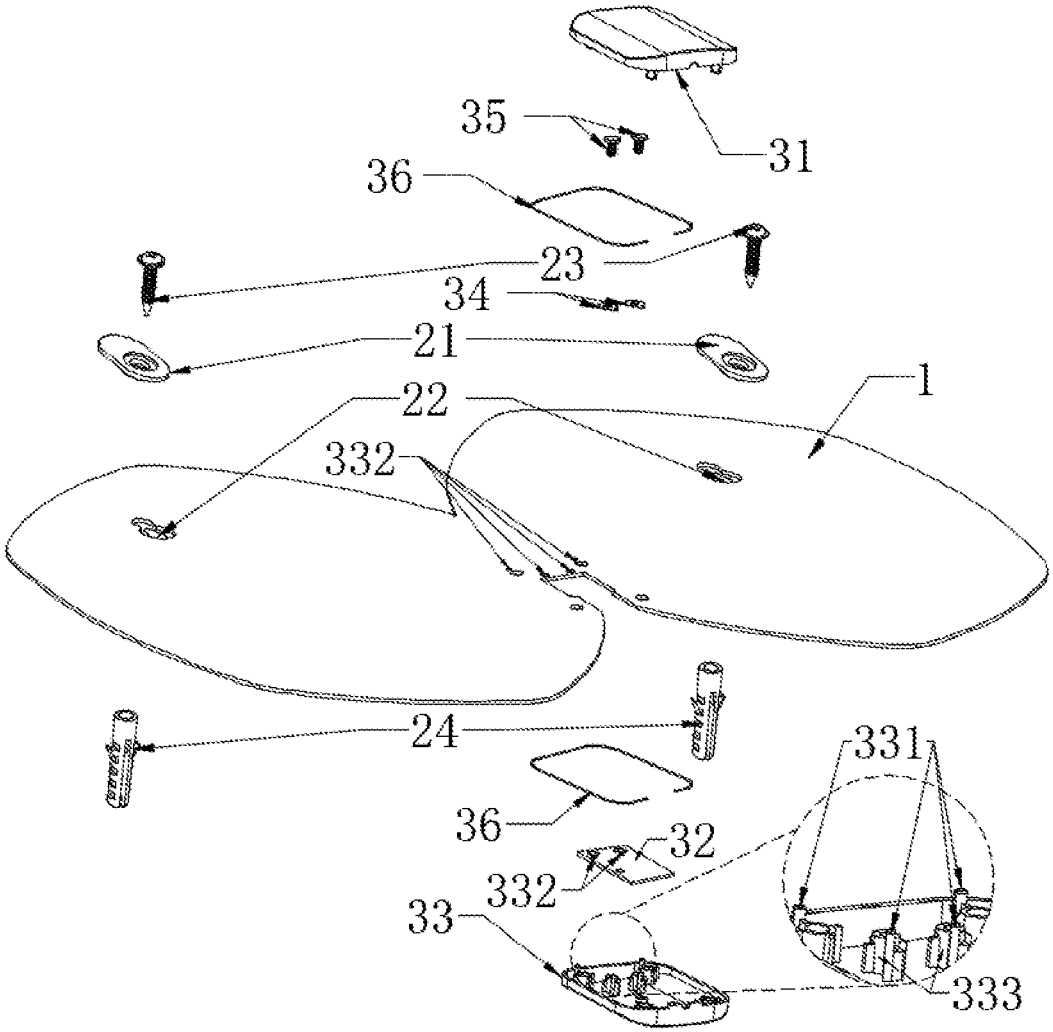
FIG. 1 is an exploded view of an antenna according to the present invention.
Figure 2:
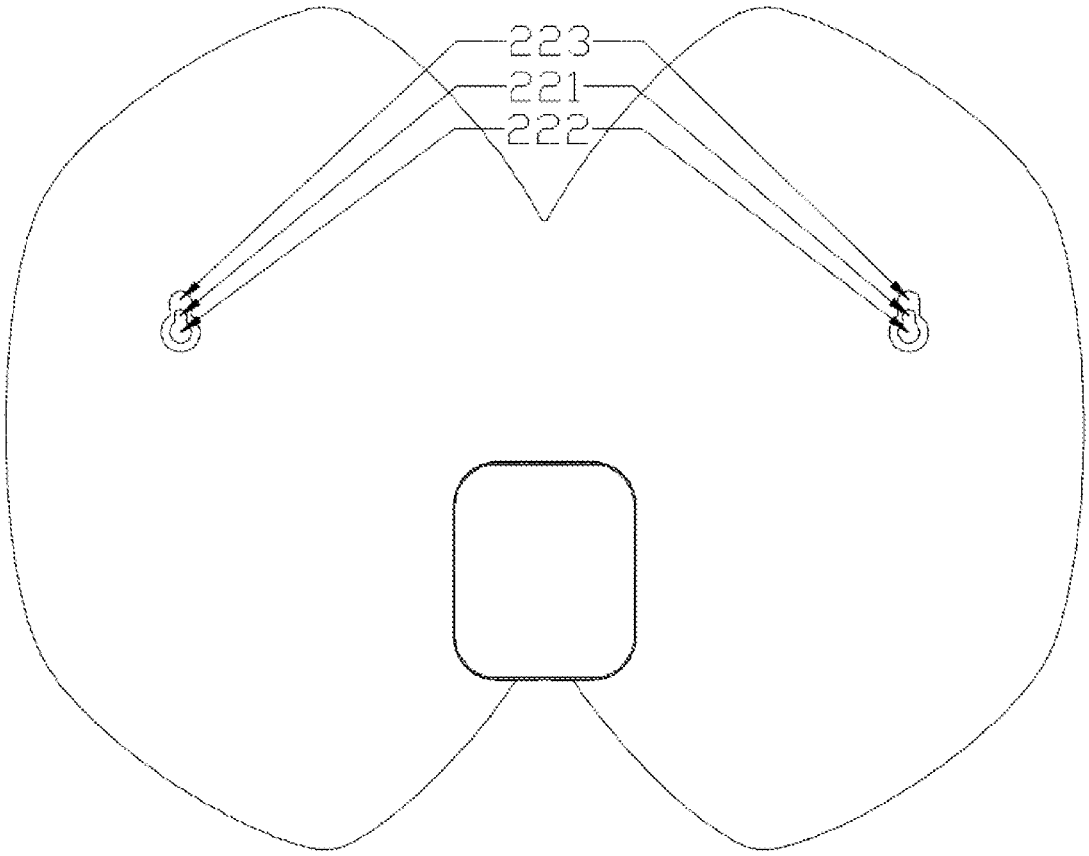
FIG. 2 is a front outside view of an antenna according to the present invention.
Figure 3:
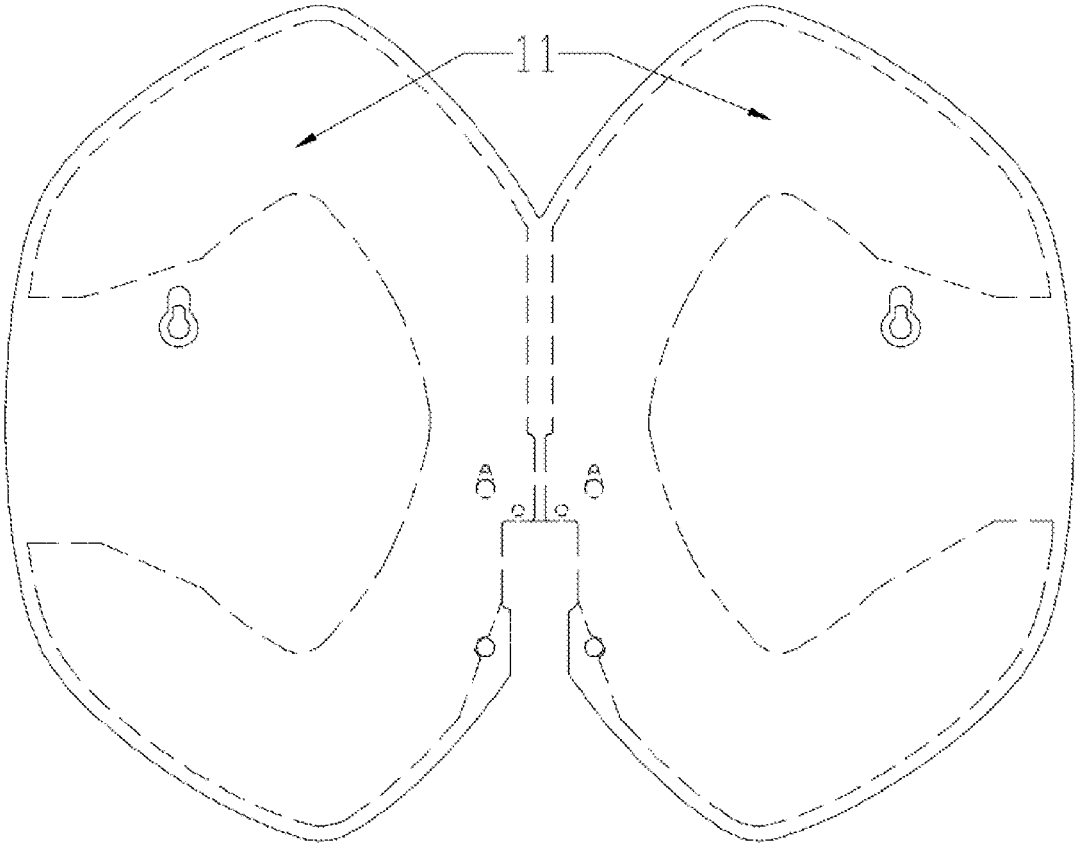
FIG. 3 is a schematic view of an oscillator piece in the chip body.

A waterproof chip antenna as shown in FIG. 1-3 comprises a chip body 1, a signal processor and a deconcentrator 4, wherein the chip body comprises hanging holes 22, gaskets 21 embedded around the hanging holes 22, and an oscillator piece 11 arranged in the chip body 1 (refer to the closed structure as shown by dotted line in FIG. 3); the signal processor is installed on the chip body 1, and the connection position between the signal processor and the chip body is provided with a sealing ring 36; and the oscillator piece 11 is connected to the signal processor. The signal processor is connected to the deconcentrator 4 through a circuitry, comprising a power supply line A and a signal line B which are connected to the circuitry separately, as shown in FIG. 6.

The chip body 1 is generally hung with hard objects penetrating the hanging holes 22, such as screws and hard rods, in prior arts. According to the present invention, the hanging holes 22 are stressed uniformly through the gaskets 21 embedded around the hanging holes 22 so that the hanging holes 22 may avoid wear and tear caused by local stress from the hard objects, which can avoid that the chip body 1 is wear through by the hard objects to make water entry into and thus affecting the signal reception of the antenna. The sealing ring 36 arranged between the signal processor and the chip body 1 can prevent the signal processor from short circuit caused by water to affect the signal reception. The deconcentrator 4 divides the circuitry into the power supply line A and the signal line B. As the form of the power supply line A can be USB plug as shown in FIG. 6 or common household AC power plug, and the signal line B can be common signal line as shown in FIG. 6, such as coaxial line, it's convenient connection for users. While the existing power supply line A is combined with the signal line B through special plugs which may not be matched with electric appliance, thus it's inconvenient connection with the electric appliance for users. According to the present invention, the line is not divided at the position of the signal processor but divided by the deconcentrator 4 in a unified manner. Such arrangement can avoid water entering into the signal processor and ensure the waterproofness of the antenna. In addition, the chip setting mode facilitates arrangement of the antenna at different places to adjust the signal reception. The hanging holes 22 also facilitate outdoor hanging, making the antenna with high flexibility. In conclusion, the waterproof chip antenna according to the present invention has good waterproofness and is suitable for outdoor use.

Specifically, two hanging holes 22 and two gaskets 21 are provided separately. Through the hanging holes 22 and the gaskets 21, the antenna is fixed to a wall surface by two 3.5 cm self-tapping screws with cross round head 23 cooperated with two expansion pipes 24.

Figure 4A:
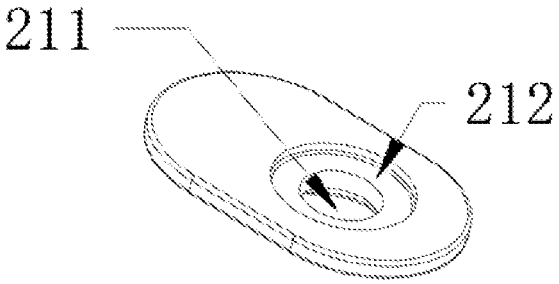
FIG. 4*a* is a schematic view of a gasket according to the present invention.
Figure 4B:
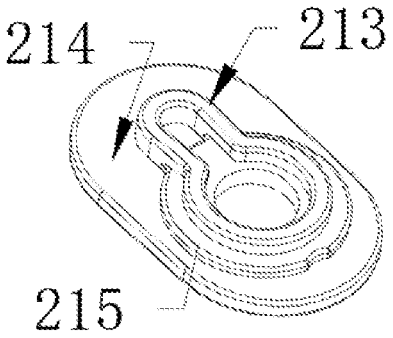
FIG. 4*b* is another schematic view of the gasket according to the present invention.

Actually, the chip body 1 is fused by two pieces of PVC material through a high-frequency machine, among which is aluminum foil with thickness of 0.6-3 mm as the material of the oscillator piece 11 and pulp can be added to increase thickness and structural strength, so that the thickness of the chip body 1 is between 1 mm and 1.8 mm. Through such configuration, the overall hardness of the chip body is proper, and the chip body is not liable to deform and can be recovered after slightly bending. In addition, the raw edge of the PVC material fused by the high-frequency machine is small, which may not scratch users' hands and affect beauty itself. As shown in FIG. 4*a* and FIG. 4*b*, each gasket 21 comprises a filling part 213 embedded around the hanging hole 22 and a hole part 211 penetrating the filling part 213.

When the antenna is hung up through the hole part 211, the hole part 211 is locally stressed, while the filling parts 213 makes the hanging holes 22 stressed uniformly, so that the hanging holes 22 may avoid wear and tear caused by local stress from the hard objects, which can avoid that the chip body 1 is wear through by the hard objects to make water entry into and thus affecting the signal reception of the antenna.

The filling part 213 is embedded around the hanging hole 22 by interference fit with the handing hole 22.

The gasket 21 further comprises a gasket face 214 arranged on one side of the filling part 213, and the hole part 211 penetrates the gasket face 214 and the filling part 213.

When arranged outdoors, the antenna position is easy to change due to strong wind, rainfall or other factors, causing that the antenna may be moved to the position with weak signal, affecting signal reception. The antenna is also easy to be damaged in movement process, so the antenna shall be fixed with screws or other fasteners at the position with good signal reception effect. The gasket face 214 is configured so that the screws or other fasteners may not directly contact with the chip body 1, but the antenna is fixed indirectly by pressing the gasket face 214, as a result, the chip body 1 is free from wear, reducing the possibility of wear through of the chip body 1. Thus, the chip body 1 remains beautiful while its wear resistance and waterproofness are improved.

The gasket face 214 comprises a pressure groove 212 arranged on the periphery of the hole part 211.

The pressure groove 212 is arranged so that no indentation affecting beauty is formed on the surface when the gasket face 214 is pressed by the screws 23, since the pressure groove 212 is equivalent to the preset indentation. In addition, the design of the pressure groove 212 is similar to a seam allowance, which improves the airtightness. Accordingly, the connection position between the screws 23 and the pressure groove 212, the hole part 211, even the periphery of the fixed position of the screws 23 and the expansion pipe 24 may avoid to be contaminated by sundries, thus improving the whole stability.

The chip body 1 is further provided with a groove 223 around the periphery of the hanging hole 22, and the gasket 21 is provided with a pad 215 fit to the groove 223. The design of the groove 223 and the pad 215 is similar to the seam allowance which improves the airtightness, so that the connection position between the gasket 21 and the hanging hole 22 may be prevented from being contaminated, and the gasket 21 may thus avoid being separated from the hanging hole 22 easily. Therefore, the wear resistance and the waterproofness are improved.

As shown in FIG. 2, each hanging hole 22 comprises a smaller first pinhole 221 and a larger second pinhole 222 which are both on the chip body 1.

When the waterproof chip antenna according to the present invention is used with the gasket 21 removed, the smaller first pinhole 221 facilitates the antenna to be hung up by a support part firmly, and the larger second pinhole 222 facilitates the antenna to be taken from the support part easily. Especially, the antenna is fixed in the first pinhole 221 by the screws 23 with a large edge and a small head, while through the second pinhole 222 the antenna can be easily taken out from the screws 23.

As shown in FIG. 1, the chip processor comprises a shell installed on the chip body 1 and a circuit unit 32 arranged in the shell; and the connection position between the shell and the chip body 1 is provided with a sealing ring 36. The shell comprises a face shell 31 and a bottom shell 33 which are correspondingly installed on both sides of the chip body 1, and the connection position between the face shell 31 and the chip body 1 and the connection position between the bottom shell 33 and the chip body 1 are provided with the sealing rings 36 separately; and the circuit unit 32 is arranged between the bottom shell 33 and the chip body 1. The face shell 31 and the bottom shell 33 are correspondingly installed on both sides of the chip body 1, rather than on one side of the chip body, so that the structural stability is improved. Thus, during assembly, the face shell 31 and the bottom shell 33 are indirectly arranged on the chip body 1 with the face shell 31 and the bottom shell 33 fixed, rather than directedly fixed on the chip body 1, so that the chip body 1 is prevented from being worn out, and the wear resistance and waterproofness are improved.

The face shell and the bottom shell are correspondingly installed through fasteners distributed uniformly. The fasteners distributed uniformly ensure uniform stress and high stability. The fasteners are specifically two 2.6 cm self-tapping screws with cross thin head 35 and two copper sheets 34 which are matched with each other.

The bottom shell 33 is provided with clips 331, and the chip body 1 and the circuit unit 32 are provided with clamping holes 332 matched with the clips 331. Such arrangement facilitates improving the stability of the integral structure.

The bottom shell 33 is provided with circuit unit supports 333 on which the circuit unit 32 is installed. The circuit unit 22 is suspended overhead in the bottom shell 33 through the circuit unit support 333, so that the circuit unit 32 is not liable to come into contact with water even water enters into the bottom shell 33, as a result, the waterproofness is further improved. In the specific implementation process, the circuit unit is a filter amplifying circuit.

The deconcentrator 4 comprises a shell, and a power supply line A and a signal line B which are arranged in the shell. The amplifying circuit is connected with the signal processor. One end of the shell is provided with a wiring part 43 used for connecting the signal processor line, and the other end of the shell is provided with an outgoing line part 44 used for leading out the power supply line A and the signal line B. The line is divided into the power supply line A and the signal line B in the shell.

As shown in FIG. 5*a* and FIG. 5*b*, the shell comprises a upper shell 41 and a lower shell 42 which are matched with each other and installed, and the circuit unit is installed between the upper shell 41 and the lower shell 42; the wiring part 43 for connecting the signal processor line is formed by one end of the upper shell 41 and the lower shell 42 jointly, and the outgoing line part 44 for leading out the power supply line A and the signal line B is formed by the other end of the upper shell 41 and the lower shell 42 jointly As shown in FIG. 5*c* and FIG. 5*d*, the deconcentrator 4 further comprises two movable clamp tails 45 matched with the outgoing part, and the power supply line A and the signal line B are led out through the two movable clamp tails 45 separately. The movable clamp tails 45 are arranged so that the power supply line A and the signal line B can be sheathed into the two movable clamp tails 45 separately, facilitating the line design and mass production, no matter how lengths of the power supply line A and the signal line B are set.

The movable clamp tails 45 are provided with notches 46, and the upper shell 41 and the lower shell 42 are provided with slots 44 matched with the notches 46 separately; and the movable clamp tails 45 are clamped by the upper shell 41 and the lower shell 42 through the slots 44.

The slots 44 are provided with convex points 47 used for fixing the movable clamp tails 45.

The upper shell 41 and the lower shell 42 are matched with each other and installed through a fixing structure 48. The design of the fixing structure 48 can improve the airtightness of the upper shell 41 and the lower shell 42, in favor of waterproof.

The upper shell 41 and the lower shell 42 are buckled with each other and installed through a buckling structure 49. Such arrangement can improve the overall stability of the deconcentrator 4.

What is claimed is:

1. A waterproof chip antenna, comprising a chip body, wherein the chip body comprises a hanging hole, a gasket embedded on the peripheries of the hanging hole, and an oscillator piece arranged in the chip body.

2. The waterproof chip antenna according to claim 1, wherein the gasket comprises a filling part embedded on the periphery of the hanging hole and a hole part penetrating the filling part.

3. The waterproof chip antenna according to claim 2, wherein the filling part is embedded on the periphery of the hanging hole by interference fit with the handing hole.

4. The waterproof chip antenna according to claim 2, wherein the gasket further comprises a gasket face arranged on one side of the filling part, and the hole part penetrates the gasket face and the filling part.

5. The waterproof chip antenna according to claim 4, wherein the gasket face comprises a pressure groove arranged on the periphery of the hole part.

6. The waterproof chip antenna according to claim 1, wherein the chip body is further provided with a groove around the periphery of the hanging hole, and the gasket is further provided with a pad fit to the groove.

7. The waterproof chip antenna according to claim 1, wherein the hanging hole comprises a first pinhole and a second pinhole arranged in the chip body with different sizes.

8. The waterproof chip antenna according to claim 1, wherein more than one hanging hole is provided.

9. The waterproof chip antenna according to claim 1, further comprising a signal processor installed on the chip body, wherein the connection position between the signal processor and the chip body is provided with a sealing ring; and the oscillator piece is connected to the signal processor.

10. The waterproof chip antenna according to claim 9, wherein the chip processor comprises a shell installed on the chip body and a circuit unit arranged in the shell and connected to the oscillator piece; and the connection position between the shell and the chip body is provided with a sealing ring.

11. The waterproof chip antenna according to claim 10, wherein the shell comprises a face shell and a bottom shell which are correspondingly installed on both sides of the chip body, and the connection positions between the chip body and the face and bottom shell are provided with a sealing ring, respectively; and the circuit unit is arranged between the bottom shell and the chip body.

12. The waterproof chip antenna according to claim 11, wherein the face shell and the bottom shell are correspondingly installed through fasteners distributed uniformly.

13. The waterproof chip antenna according to claim 10, wherein the bottom shell is provided with a clip, and the chip body is provided with a clamping hole matched with the clip.

14. The waterproof chip antenna according to claim 10, wherein the shell is provided with a circuit unit support on which the circuit unit is installed.

15. The waterproof chip antenna according to claim 9, further comprising a deconcentrator including a power supply line and a signal line, wherein the signal processor is connected to the deconcentrator through a circuitry, and the power supply line and the signal line is connected to the circuitry separately.

16. The waterproof chip antenna according to claim 15, wherein the deconcentrator comprises a shell in which the power supply line and the signal line are arranged, one end of the shell is provided with a wiring part used for connecting the signal processor line; and the other end of the shell is provided with an outgoing line part used for leading out the power supply line and the signal line.

17. The waterproof chip antenna according to claim 16, wherein the shell comprises an upper shell and a lower shell which are correspondingly installed, and the circuit unit is installed between the upper shell and the lower shell; the wiring part for connecting the signal processor line is formed by one end of the upper shell and the lower shell jointly, and the outgoing line part for leading out the power supply line and the signal line is formed by the other end of the upper shell and the lower shell jointly.

18. The waterproof chip antenna according to claim 16, wherein the deconcentrator further comprises two movable clamp tails fit to the outgoing part, through which the power supply line and the signal line are separately led out.

19. The waterproof chip antenna according to claim 18, wherein the movable clamp tails are provided with notches, and the shell is provided with slots fit to the notches; and the movable clamp tails are clamped by the shell through the slots.

20. The waterproof chip antenna according to claim 19, wherein the slots are provided with convex points used for fixing the movable clamp tails.

* * * * *